US009284087B2

(12) United States Patent
Takeuchi

(10) Patent No.: US 9,284,087 B2
(45) Date of Patent: Mar. 15, 2016

(54) DIE-CUTTING BLADE AND CASE-FORMING DIE-CUT BLANK

(75) Inventor: Takayuki Takeuchi, Toyonaka (JP)

(73) Assignee: NIPPON DIE STEEL CO., LTD., Osaka (JP)

( * ) Notice: Subject to any disclaimer, the term of this patent is extended or adjusted under 35 U.S.C. 154(b) by 487 days.

(21) Appl. No.: 13/497,074

(22) PCT Filed: Oct. 29, 2010

(86) PCT No.: PCT/JP2010/069327
§ 371 (c)(1),
(2), (4) Date: Apr. 4, 2012

(87) PCT Pub. No.: WO2012/001827
PCT Pub. Date: Jan. 5, 2012

(65) Prior Publication Data

US 2012/0181326 A1 Jul. 19, 2012

(30) Foreign Application Priority Data

Jun. 30, 2010 (JP) ..... 2010-149022

(51) Int. Cl.
*B65D 5/02* (2006.01)
*B26F 1/44* (2006.01)
*B65D 5/42* (2006.01)

(52) U.S. Cl.
CPC ..... *B65D 5/0227* (2013.01); *B26F 1/44* (2013.01); *B65D 5/42* (2013.01);
(Continued)

(58) Field of Classification Search
USPC ..... 30/346.56, 355; 83/333
IPC ..... B26D 2001/006,9/02; B23D 19/065; B26F 2001/4472, 2001/4481
See application file for complete search history.

(56) References Cited

U.S. PATENT DOCUMENTS 122,008 A * 12/1871 Hagerty ..... 83/333
556,615 A * 3/1896 Campbell ..... 30/355
(Continued)

FOREIGN PATENT DOCUMENTS

CN 1445076 10/2003
CN 1467080 1/2004
(Continued)

OTHER PUBLICATIONS

International Search Report issued Dec. 28, 2010 in International (PCT) Application No. PCT/JP2010/069327.
(Continued)

*Primary Examiner* — Kenneth E Peterson
(74) *Attorney, Agent, or Firm* — Wenderoth, Lind & Ponack, L.L.P.

(57) ABSTRACT

A die-cutting blade can form smooth die-cut lines in case-forming blanks which are less likely to injure hands when touched. A strip-plate-shaped steel blade plate has a pair of chamfers formed on opposite side surfaces of the blade plate, respectively, so as to extend from one side edge of the blade plate at substantially equal inclination angles. The chamfers define a cutting edge along the one side edge. The cutting edge has a composite wave pattern formed from a small wave pattern bent to have a wave shape within the range of the thickness of the blade plate, and a large wave pattern formed by a large undulation in the small wavy edge toward opposite side surfaces of the blade plate over its entire length within the range of the thickness of the blade plate, in order to provide smooth die-cut lines.

7 Claims, 9 Drawing Sheets

(52) U.S. Cl.
CPC *B26F 2001/4472* (2013.01); *B26F 2001/4481* (2013.01); *B31B 2201/252* (2013.01); *B31B 2203/066* (2013.01); *Y10T 83/4801* (2015.04); *Y10T 83/929* (2015.04)

(56) References Cited

U.S. PATENT DOCUMENTS

| | | | | | |
|---|---|---|---|---|---|
| 2,086,620 | A | * | 7/1937 | Hoffman | 30/315 |
| 2,834,108 | A | * | 5/1958 | Thompson | 30/355 |
| 4,967,477 | A | * | 11/1990 | Sanford | 30/315 |
| 5,421,090 | A | * | 6/1995 | Chiou | 30/254 |
| 5,741,570 | A | | 4/1998 | Seufert | |
| 6,382,068 | B1 | * | 5/2002 | Balke | 83/847 |
| 6,532,852 | B1 | * | 3/2003 | Tsujimoto et al. | 83/661 |
| 6,668,691 | B1 | * | 12/2003 | Jakobi | B26F 3/002 428/343 |
| D654,325 | S | * | 2/2012 | Ono et al. | D7/649 |
| 2007/0039445 | A1 | * | 2/2007 | Nitsch | 83/835 |

FOREIGN PATENT DOCUMENTS

| | | |
|---|---|---|
| CN | 2710886 | 7/2005 |
| EP | 0 546 392 | 6/1993 |
| JP | 45-1395 | 1/1970 |
| JP | 57-81099 | 5/1982 |
| JP | 11-278464 | 10/1999 |
| JP | 11-333798 | 12/1999 |
| JP | 2000-127258 | 5/2000 |
| JP | 2001-191297 | 7/2001 |
| JP | 2002-326624 | 11/2002 |
| JP | 3851874 | 11/2006 |
| JP | 2008-044664 | 2/2008 |

OTHER PUBLICATIONS

Chinese Office Action, issued Dec. 10, 2013 (with English translation) in a Chinese application that is a foreign counterpart to the present applicationin.

Extended European Search Report issued Aug. 31, 2015 in corresponding European Application No. 10854124.4.

* cited by examiner

DIE-CUTTING BLADE AND CASE-FORMING DIE-CUT BLANK

TECHNICAL FIELD

The present invention relates to die-cutting blades for use in die cutting for sheets, such as corrugated paperboard sheets and cardboards, into predetermined shapes, and also relates to case-forming die-cut blanks.

BACKGROUND ART

Multi-packs collectively packing a plurality of to-be-packed objects, such as cans and bottles filled with drinking water or beer, are usually packed with a wrap around case K illustrated in FIG. 10. Further, the wrap around case K is brought into an assembled state, by performing folding and adhering on a blank, which is formed by performing-die cutting and scoring on a corrugated paperboard sheet.

FIG. 9 illustrates a blank B as a material to form a wrap around case K. This blank B includes two pairs of side panels 1 and 2 having different widthwise sizes which are alternately and continuously provided in a single direction with vertical fold lines "a" interposed therebetween, a joint tab panel 3 provided continuously on a side edge of a smaller-width side panel 1 positioned in one side with a vertical fold line "a" interposed therebetween, inner flaps 4 provided continuously on the respective opposite ends of the pair of smaller-width side panels 1 with lateral fold lines "b" interposed therebetween, and outer flaps 5 provided continuously on the respective opposite ends of the remaining pair of larger-width side panels 2 with lateral fold lines "b" interposed therebetween.

In assembling the wrap around case K using the blank B, one pair of side panels 1 and the remaining pair of side panels 2 are formed into a rectangular tubular shape as illustrated in FIG. 10 by folding them along the vertical fold lines "a", then the joint tab panel 3 and a side panel 2 are adhered to each other at their portions to be overlapped with each other to form an angular tubular body 6. Thereafter, the inner flaps 4 and the outer flaps 5 are folded inwardly, and the inner flaps 4 and the outer flaps 5 are adhered to each other at their portions to be overlapped with each other to close the body 6 at its opposite-end openings. In the first step for closing a single opening of the body 6, a plurality of multi-packs P are housed inside the body 6. Reference numeral "7" denotes an adhesive agent for adhering the inner flaps 4 and the outer flaps 5 to each other at their portions to be overlapped with each other.

On the other hand, when a wrap around case K as described above is opened at home, in order to take out a necessary number of packed objects A such as beer cans therefrom and to store the remainder without increasing its volume, in many cases, the wrap around case K is opened at its end surface formed by the upper outer flaps 5 and the upper inner flaps 4 overlapped with each other, at a state where it is placed vertically. In this case, the outer flaps 5 in the outer side are stripped from the inner flaps 4 in the inner side, by putting the hands on the end edges of the outer flaps 5.

In this case, such a blank B is formed as follows. That is, as illustrated in FIG. 11A, a cutting die 22 is provided on a lower surface of an upper die 21 which can ascend and descend with respect to a cutting plate 20 made of stainless steel. Further, by descending the cutting die 22, as illustrated in FIG. 11B, die cutting is performed on a corrugated paperboard sheet S supported on the cutting plate 20, with a die-cutting blade 23 mounted in the lower surface of the cutting die 22. For performing such die cutting, a die-cutting blade with a straight-shaped cutting edge as described in Japanese Patent Laid-open Publication No. 2000-127258 or a die-cutting blade with a wavy cutting edge as described in Japanese Patent Laid-open Publication No. 2001-191297 has been generally employed.

However, the die-cutting blade described in Japanese Patent Laid-open Publication No. 2000-127258 has a cutting edge having a straight shape and, therefore, having higher acuteness. Further, the die-cutting blade described in Japanese Patent Laid-open Publication No. 2001-191297 is made to have a single wave shape with a larger radius of curvature since its edge portion has a wave shape, and its the cutting edge has relatively-higher acuteness. Accordingly, a blank B formed by die cutting therewith also has higher acuteness at its outer peripheral cut edges and, when the outer flaps 5 are stripped from the inner flaps 4 to open the wrap around case K by putting the hands on the end edges 5*a* of the outer flaps 5, the hands may be injured by touching the end edges 5*a*. Other end edges can also injure the hands, by being touched by the hands.

To cope therewith, in order to prevent injuries of the hands, Japanese Patent Laid-open Publication No. 2008-44664 proposes a corrugated paperboard box, wherein a reference line is defined in parallel with an end edge of an outer flap, there are provided, in a lattice shape, a plurality of fold lines orthogonal to the reference line, and a plurality of fold lines intersecting therewith and, further, there is formed a crushed portion in the corrugated paperboard having rigidity from an end edge thereof to a position spaced apart therefrom, in order to increase the softness of the corrugated paperboard box.

However, the aforementioned corrugated paperboard box includes the crushed portion spreading over a wide range and, therefore, may exhibit poor strength when being closed. Further, in order to form the fold lines therein, it is necessary to perform processing for forming slots for mounting a lattice-shaped pushing piece in the cutting die 22 illustrated in FIG. 11 and, also, it is necessary to perform processing for forming fitting slots in the cutting plate 20 at positions to face the lattice-shaped pushing piece, which induces the problems of an increase in the cost and a need for higher positioning accuracy in mounting the cutting plate 20 and the cutting die 22 in the die cutting machine.

SUMMARY OF THE INVENTION

It is an object of the present invention to provide a die-cutting blade capable of forming, in sheets such as corrugated paperboard sheets or cardboard, smooth die-cut lines which are less likely to injure hands even when being touched by the hands and, further, to provide a die-cut blank made of a sheet, such as a corrugated paperboard sheet or cardboard, which enables formation of a box that is less likely to induce injuries when its outer peripheral die-cut lines are touched.

In order to solve the aforementioned problems, the present invention provides a sheet die-cutting blade comprising a strip-plate-shaped blade plate having a predetermined length and made of a steel plate, the blade plate being provided with a pair of chamfers formed on the respective side surfaces of the blade plate so as to extend from one side edge of the blade plate at substantially the same inclination angle, the chamfers defining a cutting edge along the one side edge of the blade plate, wherein the cutting edge has a composite wave pattern comprising a large wave pattern and a small wave pattern, the large wave pattern comprising a plurality of longitudinally continuous large waves, the small wave pattern comprising a plurality of longitudinally continuous small waves, wherein each of the large waves contains a plurality of the small waves, and wherein the small wave pattern is entirely located within the thickness of the blade plate.

In this case, the small wave pattern and the large wave pattern may be either wave patterns having respective sine-curve shapes with fixed pitches and fixed wave widths or wave patterns having respective curved shapes with irregular pitches and irregular widths.

The large wave pattern may be located within the thickness of the blade plate, and only the chamfers have a wave pattern having crests and troughs corresponding to the large wave pattern. Alternatively, the entire opposite side surfaces of the blade plate may have a wave pattern having crests and troughs corresponding to the large wave pattern.

In general, die-cutting blades for use in die cutting for corrugated paperboard sheets and cardboard are formed from blade plates made of strip-shaped steel plates having thicknesses in the range of 0.45 mm to 1.8 mm. Therefore, in forming a composite wave pattern comprising a large wave pattern and a small wave pattern which have respective sine-curve shapes, it is preferable that the respective pitches, the respective wave widths, and the respective radii of curvature in the large wave pattern and the small wave pattern fall within the following ranges, in view of fabrication of the respective wave patterns and the prevention of injuries due to sheet cut lines formed by the composite wave pattern.

In the large wave pattern, the pitch $P_2$ and the wave width $W_2$ of the waves preferably fall within the ranges of: $P_2$=2.0 mm to 10.0 mm, and $W_2$=0.1 mm to 1.2 mm.

The pitch $P_2$ and the wave width $W_2$ of the waves in the large wave pattern are properly determined according to the plate thickness (the thickness) of the blade plate. More specifically, when the plate thickness of the blade plate is about 0.9 mm, these values preferably fall within the ranges of: $P_2$=2.0 mm to 5.0 mm and $W_2$=0.1 mm to 0.6 mm. Further, when the plate thickness of the blade plate is about 1.07 mm, these values preferably fall within ranges of: $P_2$=3.0 mm to 6.0 mm and $W_2$=0.2 mm to 0.8 mm. In this case, the term "about" means the range of ±0.05 mm.

In the small wave pattern, the pitch $P_1$ and the wave width $W_1$ of the waves preferably fall within the ranges of $P_1$=0.2 mm to 2.0 mm, and $W_1$=0.02 mm to 0.5 mm. The pitch $P_1$ and the wave width $W_1$ of the waves in the small wave pattern are properly determined according to the pitch $P_4$ and the wave width $W_2$ of the waves in the large wave pattern such that a plurality of continuous ones of the waves in the small wave pattern are formed per single wave in the large wave pattern. More specifically, when the plate thickness of the blade plate is about 0.9 mm, these values preferably fall within the ranges of: $P_1$=0.6 mm to 1.2 mm, and $W_1$=0.05 mm to 0.2 mm. Further, when the plate thickness of the blade plate is about 1.07 mm, these values preferably fall within the ranges of $P_1$=0.8 mm to 1.4 mm and $W_1$=0.08 mm to 0.3 mm.

In order to solve the aforementioned problems, as a case-forming die-cut blank according to the present invention, there is provided a case-forming die-cut blank including two pairs of opposing side panels to form a rectangular tubular-shaped body, inner flaps provided continuously on respective end edges of one pair of side panels, and outer flaps provided continuously on respective end edges of the remaining pair of side panels, such that the outer flaps are to be adhered to the inner flaps to close an opening of the body, wherein the blank has outer peripheral edges, of which at least outer peripheral edges of the outer flaps are formed from a cut line formed by die cutting with the aforementioned sheet die-cutting blade according to the present invention, and the cut line is formed from a composite wavy line formed from a small wavy curve having an undulation with a small pitch which forms alternate and successive crests and troughs, and a large wavy curve having an undulation forming alternate and successive crests and troughs with a large pitch than that of the small wavy edge such that the large wavy curve is provided with respect to the small wavy curve as a reference, and such that a plurality of crests in the small wavy curve are formed per single crest in the large wavy curve.

In this case, assuming that the pitch of the crests is $P_3$ and the height of the crests is $H_3$ in the small wavy curve, and the pitch of the crests is $P_4$ and the height of the crests is $H_4$ in the large wavy curve, in view of preventing injuries of the hands, it is preferable that these values fall within the ranges of: $P_3$=0.2 mm to 2.0 mm and $H_3$=0.02 mm to 0.5 mm, and $P_4$=2.0 mm to 10.0 mm and $H_4$=0.1 mm to 1.2 mm.

As described above, according to the present invention, the cutting edge in the die-cutting blade for use in die cutting for sheets such as corrugated paperboard sheets and cardboard is formed to be the composite wave pattern formed from the small wave pattern having a small undulation toward the opposite side surfaces of the blade plate within the range of the thickness of the blade plate, and the large wave pattern formed by undulating the small wave pattern toward the opposite side surfaces of the blade plate in the longitudinal direction such that the undulation in the large wave pattern is larger than that in the small wave pattern, and such that a plurality of the waves in the small wave pattern are formed per single wave in the large wave pattern. Accordingly, as a result of die cutting on a sheet, the cut line formed by the die cutting has a wave shape having fine waves forming crests and troughs. Consequently, it is possible to provide smooth die-cut lines which softly come into contact with the hands and are less likely to injure the hands. Therefore, by forming at least the outer peripheral edges of the outer flaps from cut lines formed by die cutting with the aforementioned sheet die-cutting blade according to the present invention, it is possible to provide a significantly larger effect in preventing injuries of the hands.

Further, since the cutting edge is formed to be a composite wave pattern formed from the small wave pattern and the large wave pattern, in die cutting on corrugated paperboard sheets, it is possible to suppress formation of stripe-type elongated paper dust, from the corrugated medium paper which is formed therein in corrugated shapes. Further, since the large wavy edge is made to have an undulation within the range of the thickness of the blade plate, the blade plate is maintained at a straight-shaped strip-plate state at its portion other than the edge portion. Accordingly, for mounting the die-cutting blade in a cutting die, it is necessary only to form a straight-shaped mounting slot in the cutting die, thereby making it easier to perform the processing for forming the slot. Further, this makes it easier to mount the die-cutting blade in the cutting die.

Furthermore, with the large wave pattern formed by shaping the entire opposite side surfaces of the blade plate into a wave shape, it is possible to fabricate the large wave pattern more easily than in case of forming the large wave pattern by shaping only a portion of the blade plate into a wave shape. The blade plate also has a wave shape at its portion to be mounted in the cutting die, which enables securely mounting the blade plate in the cutting die.

EMBODIMENTS FOR CARRYING OUT THE INVENTION

Figure 1A:
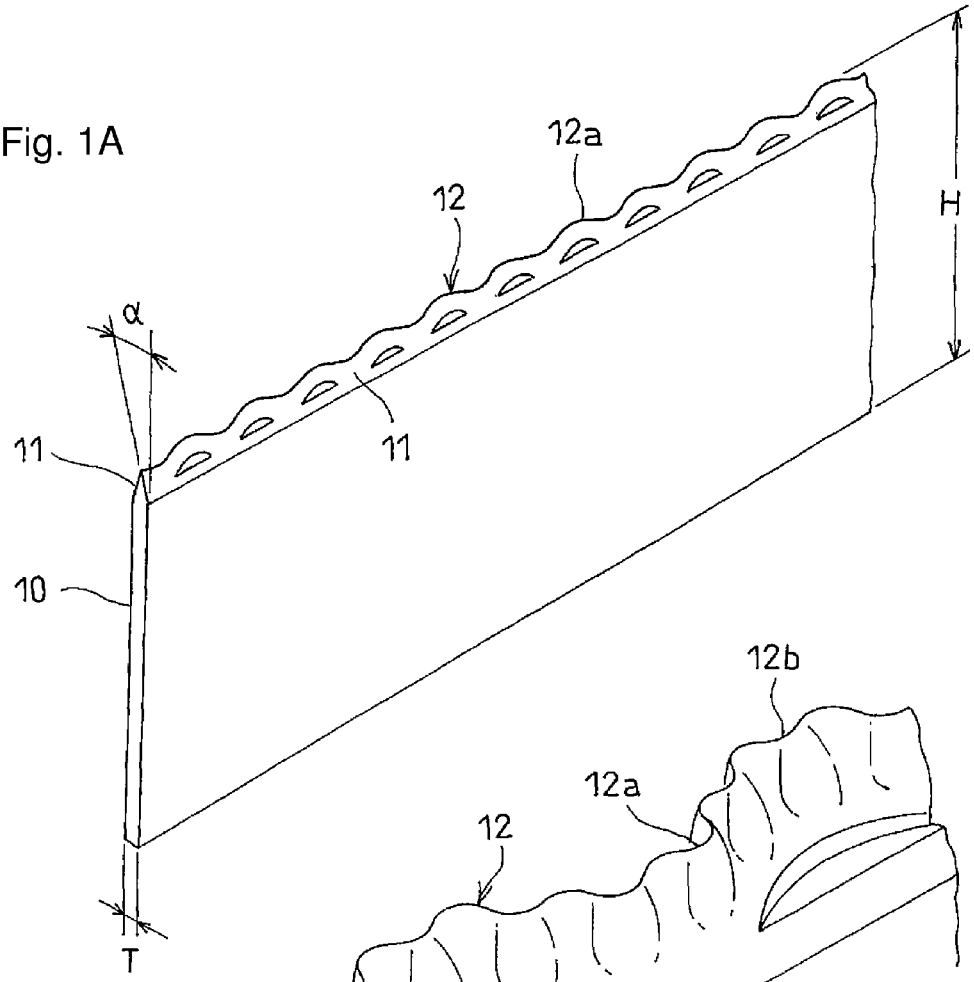
FIG. 1A is a perspective view illustrating an embodiment of a sheet die-cutting blade according to the present invention.
Figure 1B:
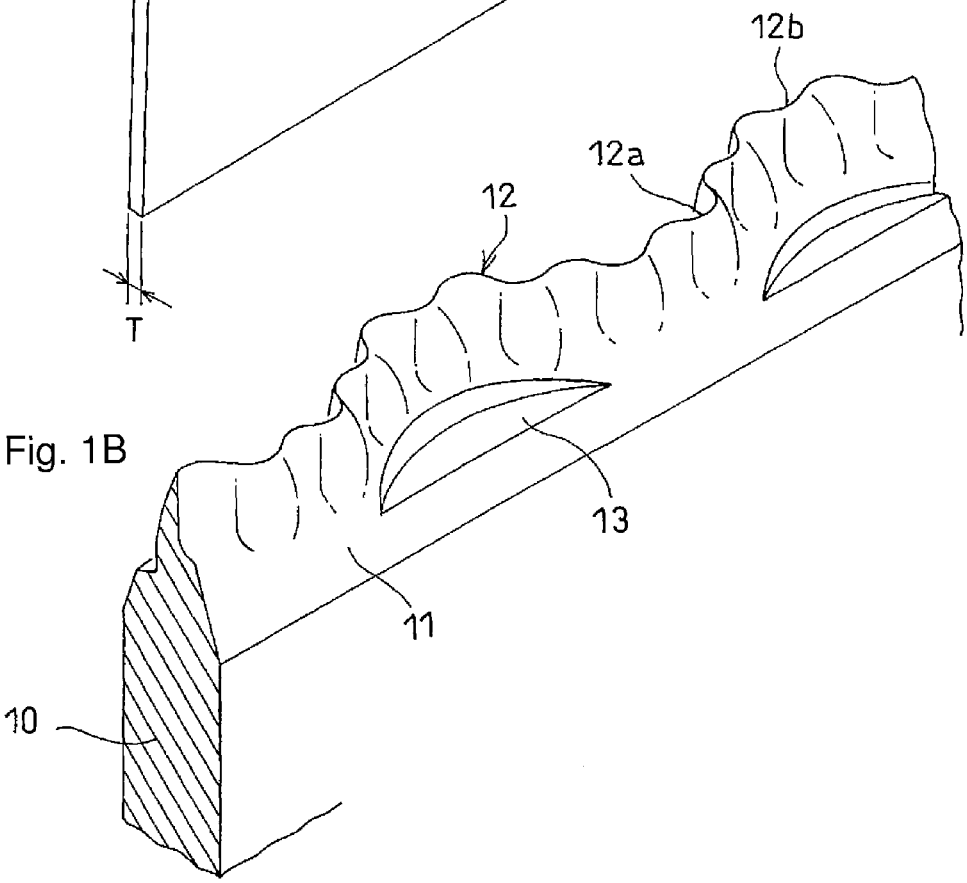
FIG. 1B is a perspective view illustrating a portion of FIG. 1A in an enlarged manner.

Hereinafter, embodiments of the present invention will be described with reference to the drawings. As illustrated in FIGS. 1A and 1B, a blade plate 10 is formed from a strip-plate-shaped steel plate having a predetermined length, wherein H is about 23.5 mm and T falls within the range of 0.45 mm to 1.8 mm, assuming that H is the height thereof and T is the thickness (the plate thickness) thereof.

The blade plate 10 is provided with a pair of chamfers 11 on its respective opposite side surfaces so as to extend from one side edge of the blade plate, i.e. one of its upper and lower side edges at substantially the same inclination angle $\alpha$ in opposite directions. The chamfers 11 define a cutting edge 12 along the one side edge.

Figure 2A:
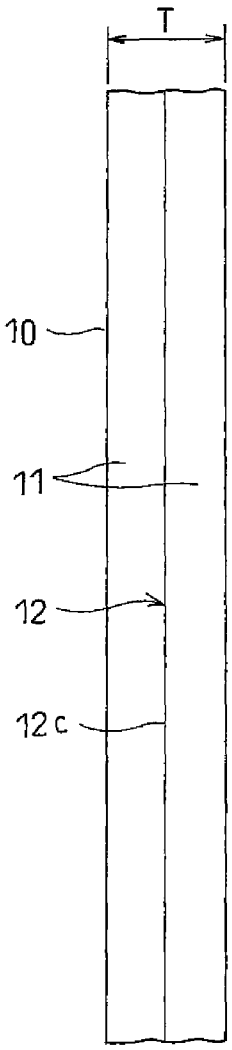
FIGS. 2A, 2C, and 2E are plan views illustrating states of formation of the sheet die-cutting blade illustrated in FIG. 1 in a stepwise manner.
Figure 2C:
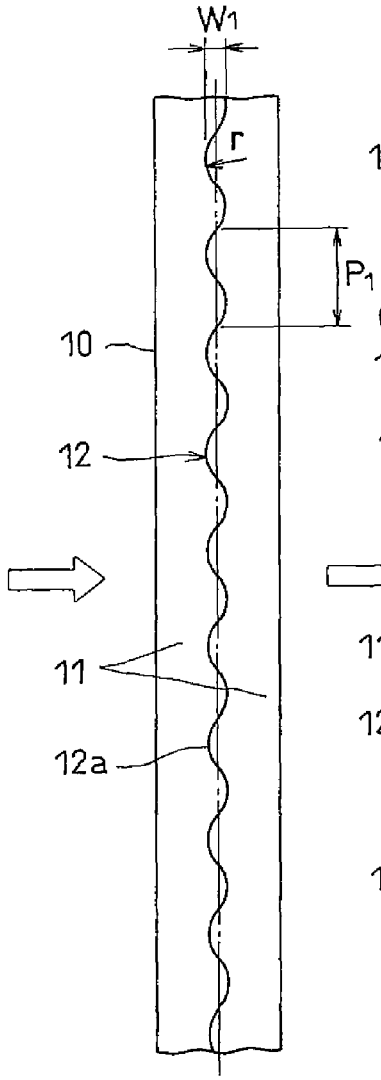
Figure 2E:
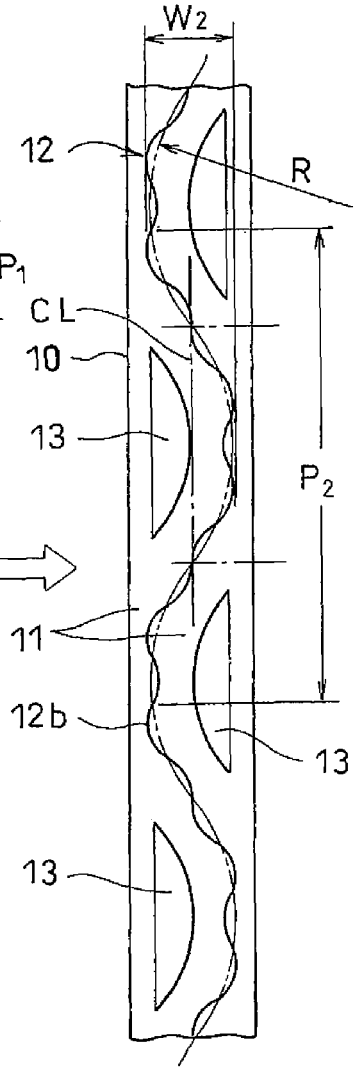

As illustrated in FIGS. 2C and 2E, the cutting edge 12 has a composite wave pattern comprising a small wave pattern 12*a* and a large wave pattern 12*b*. In other words, the cutting edge 12 is waved in the small wave pattern 12*a*, and the small wave pattern 12*a* is further waved in the large wave pattern 12*b*. The small wave pattern 12*a* has longitudinally and alternately arranged first and second crests which face in opposite directions to each other. The large wave pattern 12*b* has longitudinally and alternately arranged third and fourth crests which face in opposite directions to each other. The cutting edge is located within the thickness of the blade plate 10. Only the chamfers 11 are undulated in a composite wave pattern having vertical crests and troughs extending from the respective first to fourth crests of the small and large wave patterns 12*a* and 12*b*.

Further, as illustrated in FIGS. 2C and 2E, it is preferable that the wave width $W_1$ between the adjacent first and second crests of the small wave pattern 12*a* is made smaller than the wave width $W_2$ between the adjacent third and fourth crests of the large wave pattern 12*b*. But instead, the wave width $W_1$ may be larger than the wave width $W_2$. Also, it is possible to make the wave width $W_1$ and the wave width $W_2$ equal to each other.

The cutting edge 12 having the aforementioned structure can be formed through respective processes constituted by first to third processes as follows.

Figure 2B:
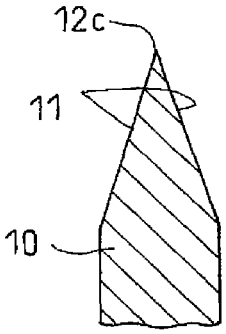
FIGS. 2B, 2D, and 2F are lateral cross-sectional views corresponding to FIGS. 2A, 2C, and 2E, respectively.

First process: as illustrated in FIGS. 2A and 2B, in the first process, the chamfers 11 are formed on the respective opposite side surfaces of the blade plate so as to extend obliquely in opposite directions from one side edge of the blade plate, i.e. one of its upper and lower side edges. By the chamfers 11, straight cutting edge 12*c* is defined which extends longitudinally substantially along the widthwise centerline of the blade plate 10.

Figure 2D:
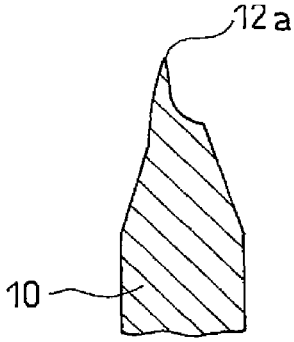

Second process: as illustrated in FIGS. 2C and 2D, the straight cutting edge 12*c* formed through the first process is formed into a sine-curve shape, through press forming using a wave-shape die plate, to form the small wave pattern 12*a* having the wave width $W_1$ between the adjacent first and second crests in alternately opposite directions in such a way as to form an undulation toward the opposite side surfaces of the blade plate 10, in the longitudinal direction, within the range of the thickness T of the blade plate 10.

Figure 2F:
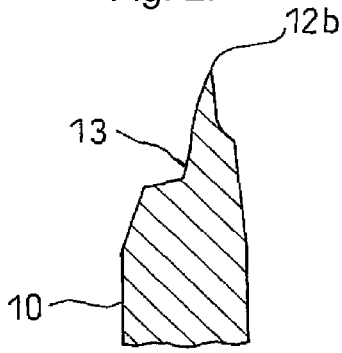

Third process: as illustrated in FIGS. 2E and 2F, the small wave pattern 12*a* formed through the second process is formed in its entirety into a sine-curve shape, through press forming using a wave-shape die plate, to form the large wave pattern 12*b* having the wave width $W_2$ between the third and fourth crests in alternately opposite directions in such a way as to form an undulation toward the opposite side surfaces of the blade plate 10 in the longitudinal direction within the range of the thickness T of the blade plate 10, by using the entire small wave pattern 12*a* as a reference. Thus, the composite wave pattern is formed. In the figures, numeral 13 denotes traces of the pressing with the wave-shape die plate.

In the small wave pattern 12*a* resulted from the shaping in the second process, if the pitch $P_1$ of its waves is excessively smaller than necessary, in view of the relationship with the wave width $W_1$ between the adjacent first and second crests in alternately opposite directions, this will increase the difficulty of shaping for the small wave pattern 12*a*. On the other hand, if the pitch $P_1$ is excessively larger than necessary, this will increase the acuteness of cut lines resulted from die cutting on sheets. Accordingly, it is preferable that the pitch $P_1$ and the wave width $W_1$ of the respective waves fall within the ranges of: $P_1$=0.2 mm to 2.0 mm, and $W_1$=0.02 mm to 0.5 mm.

On the other hand, in the large wave pattern 12*b* resulted from the shaping in the third process, if the pitch $P_2$ of its waves is excessively larger than necessary, the small wave pattern 12*a* comes closer to a straight shape in a state where it has been brought into the composite wave pattern, which makes it impossible to provide smooth cut lines which can softly come into contact with the hands. Further, if it is excessively smaller than necessary, the small wave pattern 12*a* may be broken when being shaped into the composite wave pattern. Accordingly, it is preferable that the pitch $P_2$ and the wave width $W_2$ of the waves fall within the ranges of: $P_2$=2.0 mm to 10.0 mm, and $W_2$=0.1 mm to 1.2 mm.

Further, the pitch $P_1$ in the small wave pattern 12*a* is set to be smaller than the pitch $P_2$ in the large wave pattern 12*b* such that each wave of the large wave pattern 12*b* contains a plurality of longitudinally continuous ones of the waves of the small wave pattern 12*a*.

The pitch $P_2$ and the wave width $W_2$ of the waves of the large wave pattern 12*b* are properly determined according to the plate thickness (the thickness) T of the blade plate 10. Table 1 illustrates specific examples thereof.

The pitch $P_1$ and the wave width $W_1$ of curvature of the waves in the small wave pattern 12*a* are properly determined according to the thickness T of the blade plate 10, and according to the pitch $P_2$ and the wave width $W_2$ of the large wave pattern 12*b*. Table 1 illustrates specific examples thereof.

TABLE 1

| Type of Blade Plate (Thickness of Blade Plate) | | 0.45 mm | 0.7 mm | 0.9 mm | 1.07 mm | 1.2 mm | 1.4 mm | 1.8 mm |
|---|---|---|---|---|---|---|---|---|
| Small Wavy Edge | Pitch $P_1$ (mm) | 0.2-0.6 | 0.4-0.8 | 0.6-1.2 | 0.8-1.4 | 1.0-1.6 | 1.2-1.8 | 1.2-2.0 |
| | Wave Width $W_1$ (mm) | 0.02-0.08 | 0.04-0.1 | 0.05-0.2 | 0.08-0.3 | 0.1-0.4 | 0.1-0.4 | 0.2-0.5 |
| Large Wavy Edge | Pitch $P_2$ (mm) | 2.0-3.0 | 2.0-4.0 | 2.0-5.0 | 3.0-6.0 | 4.0-7.0 | 5.0-8.0 | 6.0-10.0 |
| | Wave Width $W_2$ (mm) | 0.1-0.3 | 0.1-0.4 | 0.1-0.6 | 0.2-0.8 | 0.3-1.0 | 0.4-1.0 | 0.5-1.2 |

As described above, since the cutting edge 12 is formed to be a composite wave pattern constituted by the small wave pattern 12*a* with a small pitch $P_1$ and the large wave pattern 12*b* with a large pitch $P_2$, the composite wave pattern is provided with a plurality of wave crests in the small wave pattern 12*a* in the longitudinal direction per single wave in the large wave pattern 12*b*. In other words, each wave of the large wave pattern contains a plurality of waves of the small wave pattern.

Herein used, "each wave" of the large wave pattern 12*b* refers to any continuous portion of the large wave pattern 12*b* on either side of the widthwise centerline CL of the blade plate 10 (see FIG. 2E) (reference line).

Figure 5:
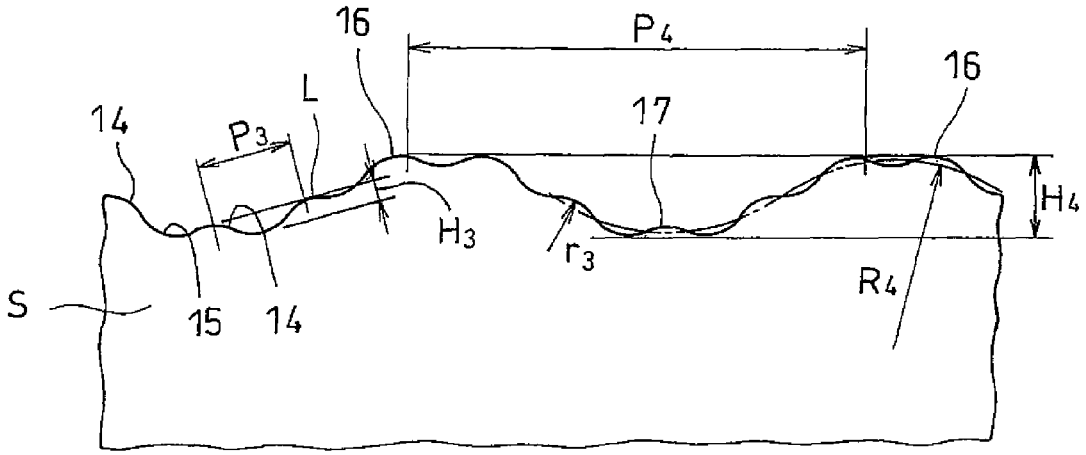
FIG. 5 is a plan view illustrating a portion of a sheet having been subjected to die cutting with the sheet die-cutting blade illustrated in FIG. 1.
Figure 11A:
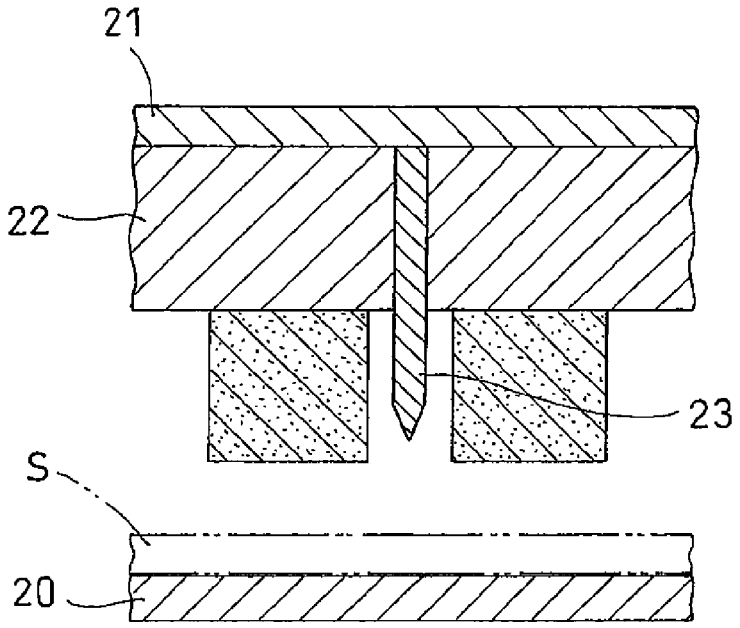
FIG. 11A is a longitudinal cross-sectional view illustrating a die cutting machine.
Figure 11B:
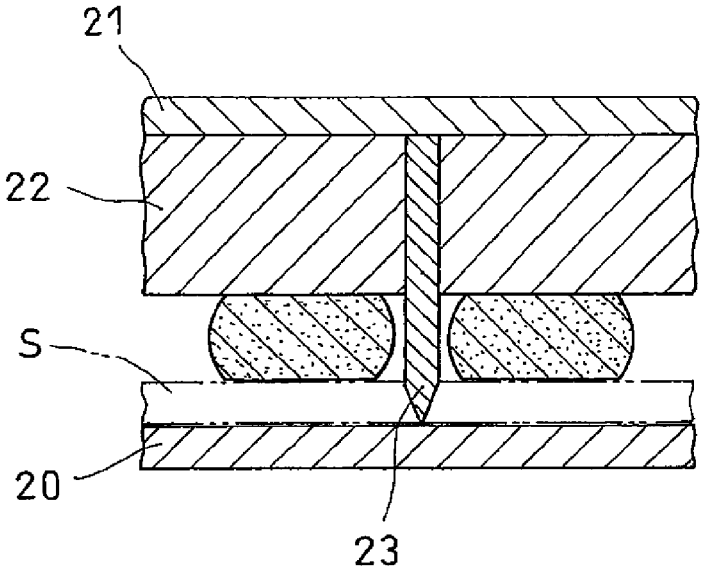
FIG. 11B is a longitudinal cross-sectional view illustrating a state of die cutting on a sheet.

The die-cutting blade according to the embodiment has the aforementioned structure. By mounting this die-cutting blade in a cutting die 22 illustrated in FIG. 11 and by performing, therewith, die cutting on a sheet S supported on a cutting plate 20, as illustrated in FIG. 5, it is possible to form, in the sheet S, a die-cut line L formed from a composite wavy line corresponding to the shape of the composite wave pattern constituted by the small wave pattern 12*a* and the large wave pattern 12*b* illustrated in FIG. 2E.

Further, since the blade plate 10 is maintained at a straight-shaped strip-plate state at its portion other than the edge portion, it is easy to perform processing for forming, in the cutting die 22, a mounting slot for inserting and mounting the blade plate 10 therein and, further, it is easy to mount the blade plate 10 therein.

The cut line L is a composite wavy line constituted by a small wavy curve having a shape with a small undulation forming alternate and successive crests 14 and troughs 15 corresponding to the shapes of the wave crests in the alternately opposite directions in the small wave pattern 12*a*, and a large wavy curve having a shape with a large undulation forming alternate and successive crests 16 and troughs 17 corresponding to the shapes of the wave crests in the alternately opposite directions in the large wave pattern 12*b*. In a preferable example, the pitch $P_3$ of the crests 14 in the small wavy curve falls within the range of 0.2 mm to 2.0 mm, and the pitch of the troughs 15 is equal thereto. Further, the height $H_3$ of the crests 14 (corresponding to the wave width $W_1$ of the small wavy edge 12*a*) falls within the range of 0.02 mm to 0.5 mm, and the depth of the troughs 15 is equal thereto. On the other hand, in a preferable example, the pitch $P_4$ of the crests 16 in the large wavy curve falls within the range of 2.0 mm to 10.0 mm, and the pitch of the troughs 17 is equal thereto. Further, the height $H_4$ of the crests 16 (corresponding to the wave width $W_2$ of the large wavy edge 12*b*) falls within the range of 0.1 mm to 1.2 mm, and the depth of the troughs 17 is equal thereto. Accordingly, the cut line L comes into contact with the hands extremely smoothly and, therefore, will not injure the hands, even if it is touched by the hands. Further, the cutting edge 12 has the same shapes as those of the small wavy curve and the large wavy curve which have been described above.

Further, the cutting edge 12 for use in die cutting for sheets S is formed to be the composite wave pattern constituted by the small wave pattern 12*a*, and the large wave pattern 12*b* formed by bending the small wave pattern 12*a* into a wave shape over its entire length in the longitudinal direction. Accordingly, during die cutting for sheets S, it is possible to suppress formation of stripe-type elongated paper dusts, particularly, from corrugated medium paper which is formed in corrugated shapes in corrugated paperboard sheets.

Figure 9:
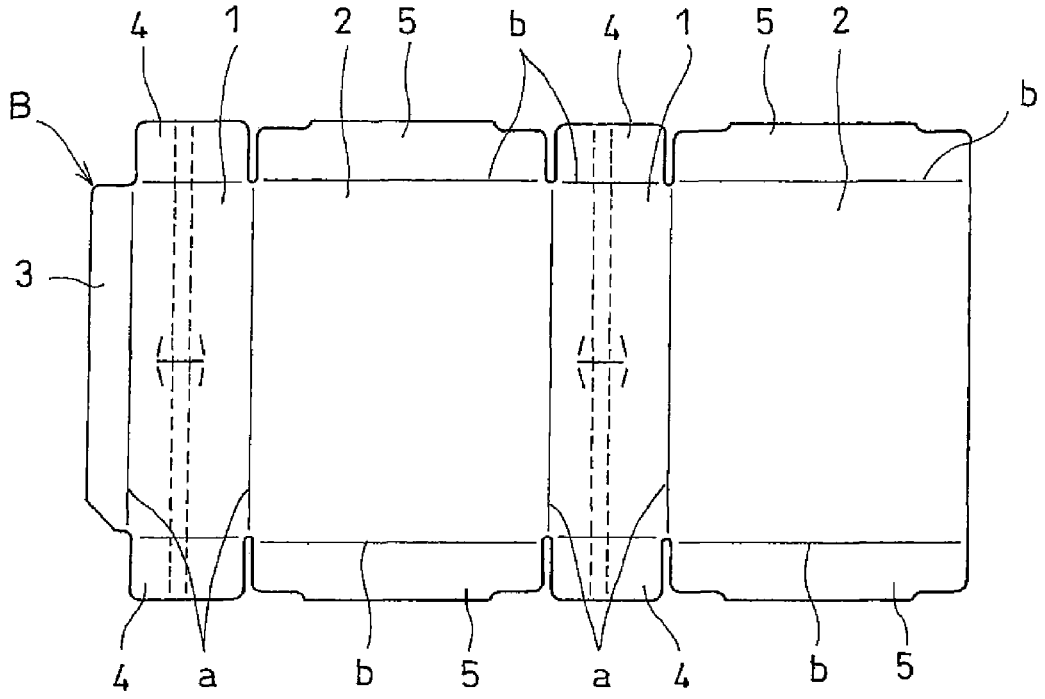
FIG. 9 is a front view illustrating a blank to form a wrap around case.
Figure 10:
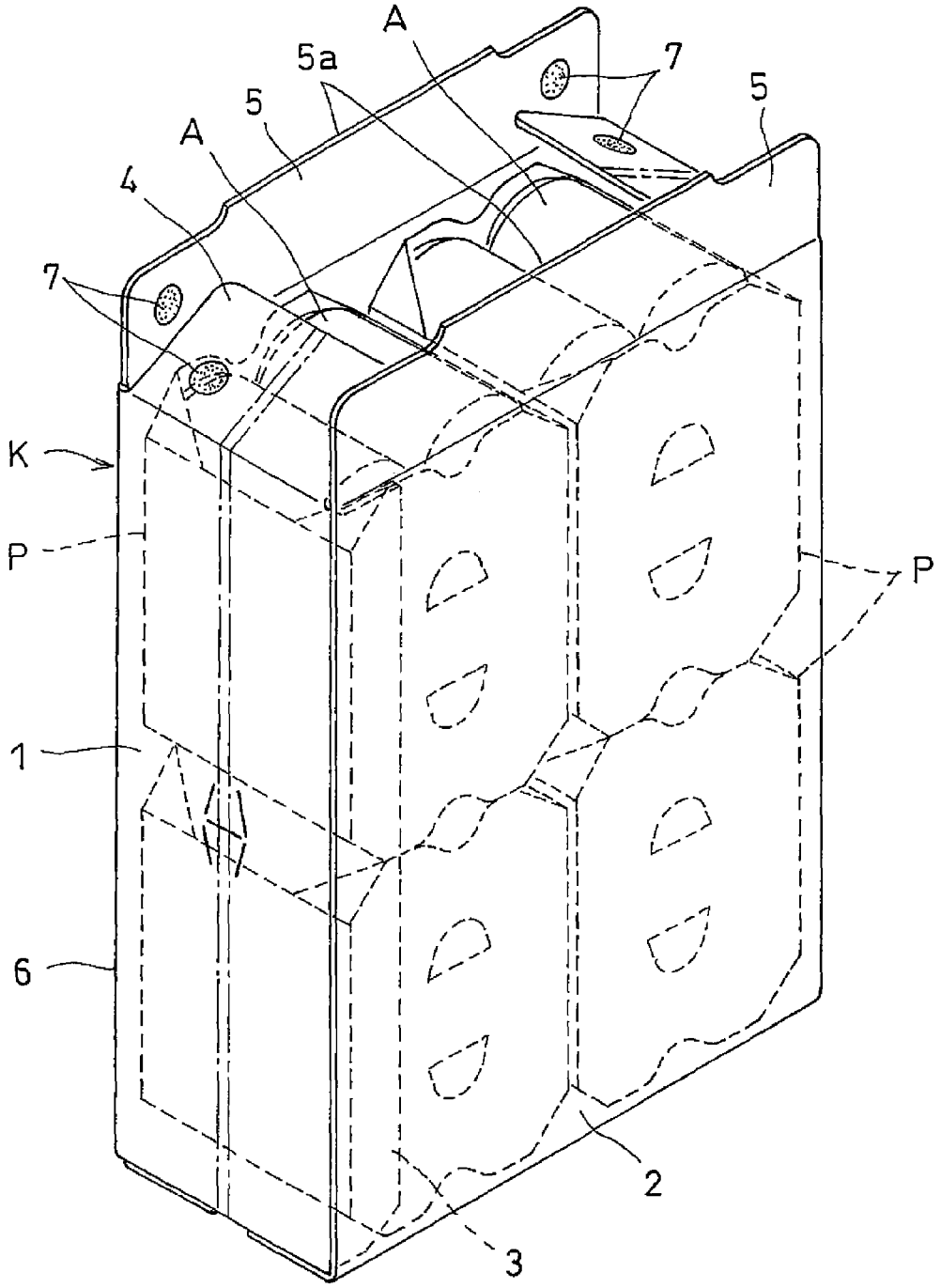
FIG. 10 is a perspective view illustrating a conventional wrap around case in an opened state.

In this case, in die cutting for a blank to form a wrap around case as illustrated in FIG. 9, its entire outer peripheral edges which form the outline can be formed from cut lines L formed from a composite wavy line constituted by a small wavy curve and a large wavy curve, or only the outer peripheral edges of the outer flaps thereof can be formed from cut lines L formed from a composite wavy line constituted by a small wavy curve and a large wavy curve.

Figure 3:
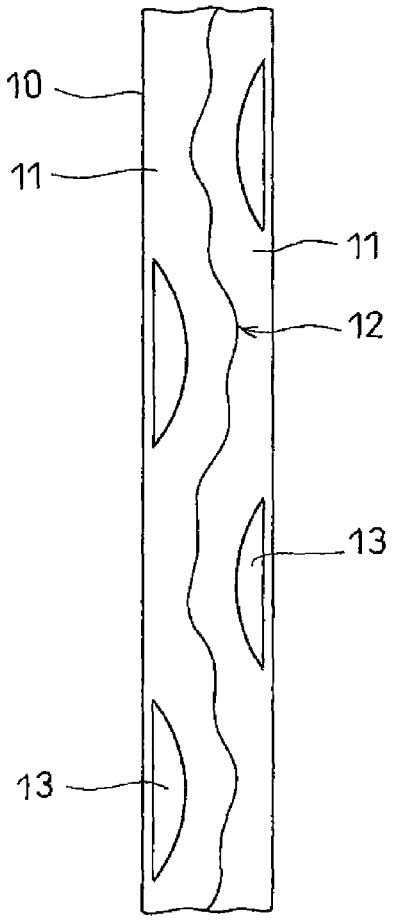
FIG. 3 is a plan view illustrating another embodiment of a sheet die-cutting blade according to the present invention.

In the embodiment illustrated in FIG. 1 and FIGS. 2C and 2E, the cutting edge 12 is formed from the small wave pattern 12*a* and the large wave pattern 12*b* which have respective regular sine-wave shapes having fixed pitches $P_1$ and $P_2$ and fixed wave widths $W_1$ and $W_2$. However, as illustrated in FIG. 3, the small wave pattern 12*a* and the large wave pattern 12*b* can have respective wave shapes with irregular pitches and irregular wave widths, provided that the cutting edge 12 is formed to be a composite wave pattern constituted by the small wave pattern 12*a* which is bent to have an undulation forming an arrangement of a plurality of wave-crests in alternately opposite directions toward the opposite side surfaces of the blade plate 10 in the longitudinal direction within the range of the thickness of the blade plate 10, and the large wave pattern 12*b* which is bent to have an undulation forming an arrangement of a plurality of wave crests in alternately opposite directions toward the opposite side surfaces of the blade plate in the longitudinal direction within the range of the thickness of the blade plate 10. Alternatively, although not illustrated in the figures, either one of the small wave pattern 12*a* and the large wave pattern 12*b* may be formed to have a wave shape with a regular pitch and a regular wave width, while the other one of them may be formed to have a wave shape with an irregular pitch and an irregular wave width. In any of the cases, the large wave pattern 12*b* can be formed by using the entire small wave pattern 12*a* as a reference, in order to form a composite wave pattern. However, the pitch in the small wave pattern 12*a* should be smaller than the pitch in the large wave pattern 12*b* such that each wave of the large wave pattern 12*b* contains a plurality of continuous ones of the waves of the small wave pattern 12*a*.

Further, in the embodiment illustrated in FIG. 1 and FIGS. 2C and 2E, both the small wave pattern 12*a* and the large wave pattern 12*b* are made to have undulations within the range of the thickness T of the blade plate 10. However, as illustrated in FIG. 7 and FIGS. 8A and 8B, the blade plate 10 itself can be made to have a large undulation in the longitudinal direction thereof in such a way as to form crests and troughs in the heightwise direction over the entire opposite side surfaces of the blade plate 10 to form the large wave pattern 12*b*, while only the small wave pattern 12*a* is made to form a wave crests and troughs in the heightwise direction within the range of the thickness of the blade plate 10 to have a small undulation therein, in order to provide a plurality of waves in the small wave pattern 12*a* per single wave in the large wave pattern 12*b*.

Figure 8A:
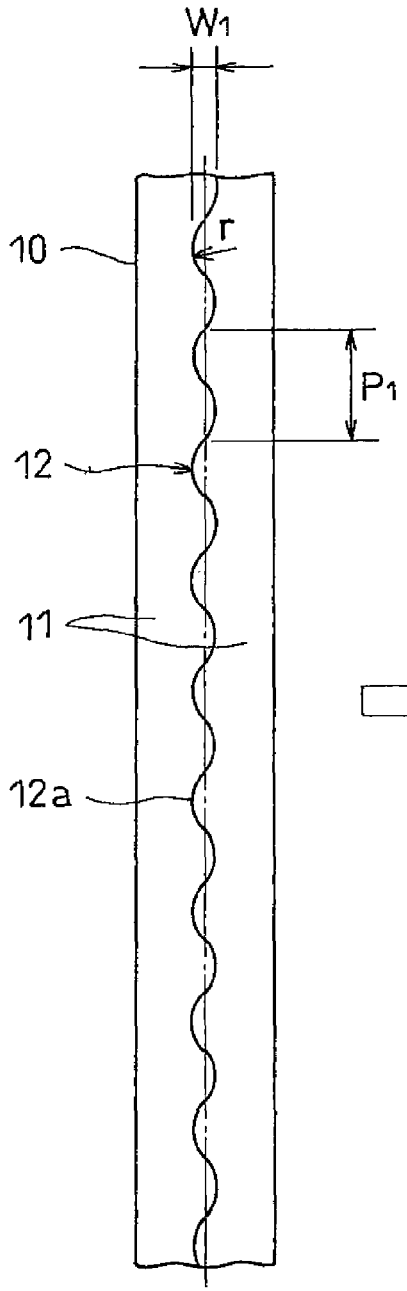
FIGS. 8A and 8B are plan views illustrating states of formation of the sheet die-cutting blade illustrated in FIG. 7 in a stepwise manner.
Figure 8B:
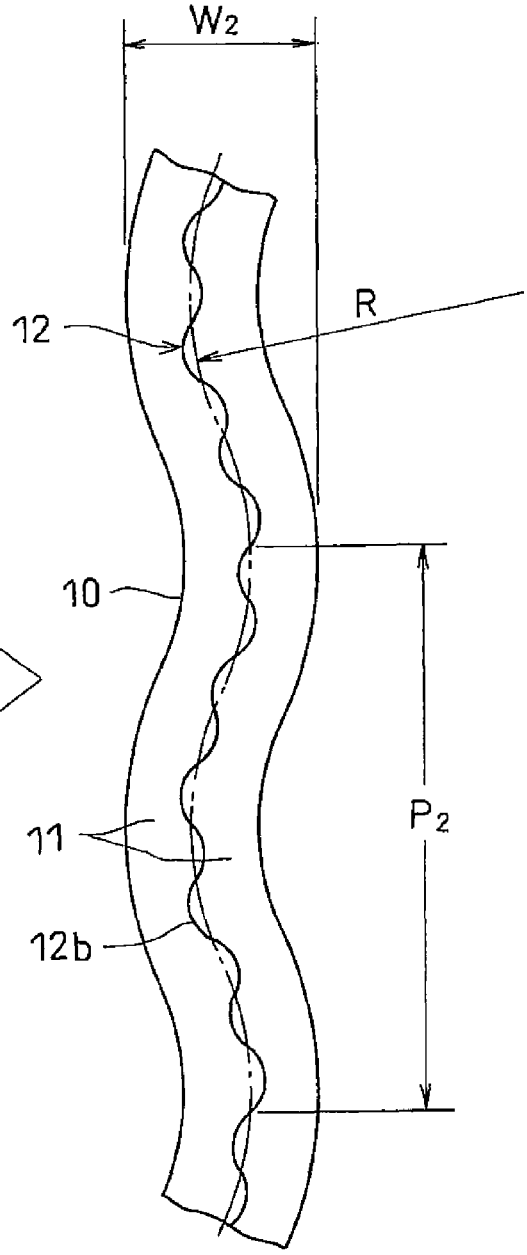

Namely, as illustrated in FIG. 8A, the small wave pattern 12*a* can be formed at the portion of the intersection of the pair of chamfers 11 formed in the blade plate 10 within the range of the thickness T of the blade plate 10 and, as illustrated in FIG. 8B, press forming can be performed on the entire blade plate 10 over its entire length for shaping the blade plate 10 into a wave shape.

Figure 7:
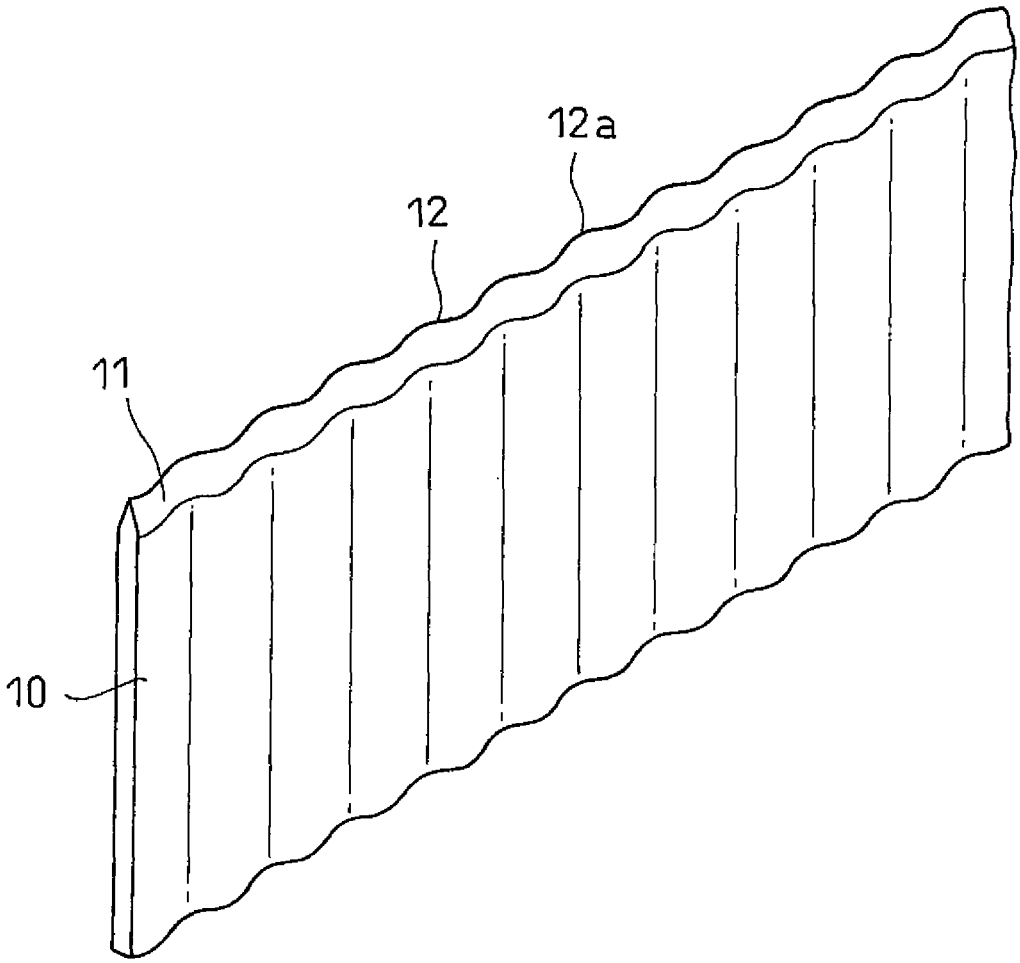
FIG. 7 is a perspective view illustrating another embodiment of a sheet die-cutting blade according to the present invention.

Further, in the embodiment illustrated in FIGS. 7 and 8, the large wave pattern 12*b* can be formed by undulating the entire blade plate 10 in the longitudinal direction thereof, which makes the fabrication of the large wave pattern 12*b* easier than in case of undulating only a portion of the blade plate 10 for forming it. The blade plate 10 also has a wave shape at its portion to be mounted in the cutting die 22, which enables mounting the blade plate 10 in the cutting die 22 in a firmly secured state.

Figure 4:
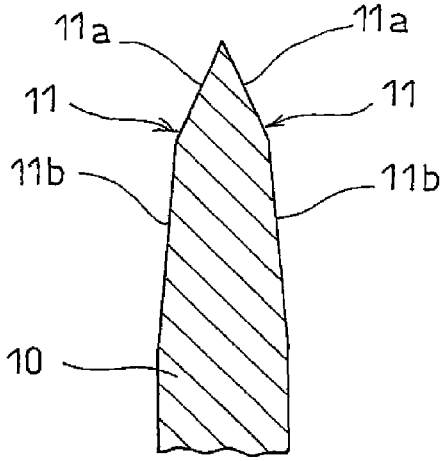
FIG. 4 is a lateral cross-sectional view illustrating another example of a blade plate.

Further, as the blade plate 10, there has been exemplified one having two chamfers 11 formed on the respective opposite side surfaces so as to extend from the cutting edge. However, the chamfers 11 are not limited thereto. For example, as illustrated in FIG. 4, two inclined surfaces 11*a* and 11*b* having different inclination angles can be continuously formed therein in order from the blade tip.

While, in the embodiment, there has been exemplified die cutting for a blank B to form a wrap around case K which is made of a corrugated paperboard sheet, the case-forming material and the case are not limited thereto. For example, it is also possible to employ package boxes made of paperboard.

Figure 6:
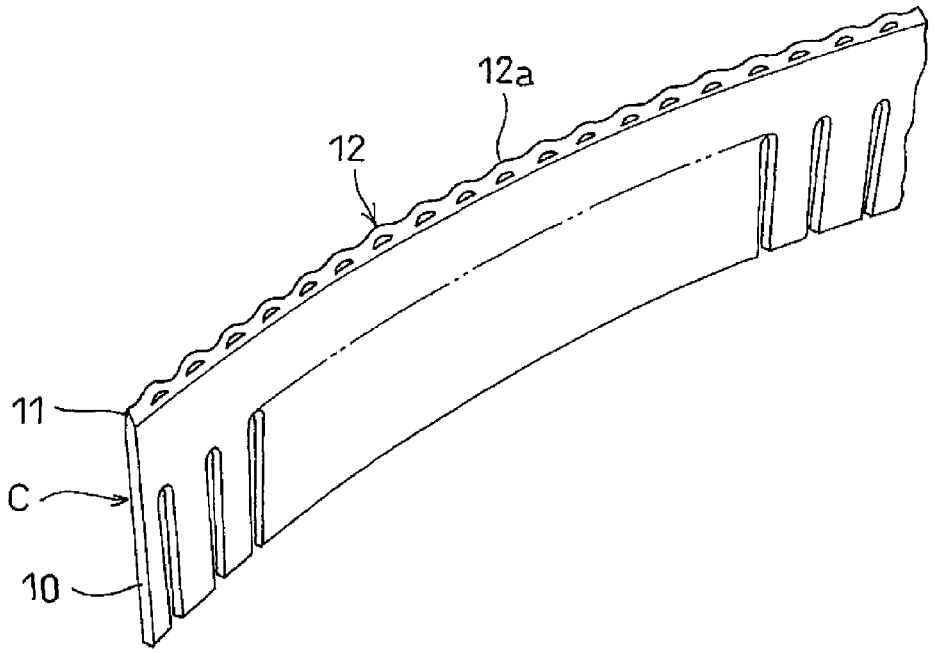
FIG. 6 is a perspective view of a die-cutting blade to be mounted in a rotary die-cutting machine.

Further, while, in the embodiment, there has been exemplified a die-cutting blade to be mounted in a cutting die in a flat die cutting machine, the die-cutting blade is not limited to one of a flat type. For example, as illustrated in FIG. 6, the die-cutting blade can be an arc-shaped die-cutting blade C to be mounted in an arc-shaped cutting die in a rotary die cutting machine.

The invention claimed is:

1. A sheet die-cutting blade comprising a strip-plate-shaped blade plate having a predetermined length and made of a steel plate having a thickness, the blade plate being provided with a pair of chamfers formed on the respective side surfaces of the blade plate so as to extend from one side edge of the blade plate at substantially the same inclination angle, the chamfers defining a cutting edge along the one side edge of the blade plate, wherein, when viewed in plan view in a direction perpendicular to the cutting edge and parallel to the blade plate, the cutting edge has a composite wave pattern comprising a large wave pattern undulating in a thickness direction of the blade plate and a small wave pattern undulating in the thickness direction of the blade plate, the large wave pattern comprising a plurality of longitudinally continuous large waves, the small wave pattern comprising a plurality of longitudinally continuous smoothly curved small waves, wherein each of the large waves contains a plurality of the small waves, and wherein the small wave pattern is entirely located within the thickness of the blade plate, wherein the wave widths $W_1$ in the small wave pattern fall within a range of $W_1$=0.02 mm to 0.5 mm.

2. The sheet die-cutting blade of claim 1, wherein the large wave pattern is located within the thickness of the blade plate, and wherein only the chamfers have a wave pattern having crests and troughs corresponding to the large wave pattern.

3. The sheet die-cutting blade of claim 2, wherein the large wave pattern and small wave pattern have respective wave curves having fixed pitches and fixed wave widths of their respective waves, and the pitch $P_2$ and the wave width $W_2$ of the waves in the large wave pattern fall within ranges of: $P_2$=2.0 mm to 10.0 mm, and $W_2$=0.1 mm to 1.2 mm.

4. The sheet die-cutting blade of claim 1, wherein the large wave pattern and small wave pattern have respective-wave curves having fixed pitches and fixed wave widths of their respective waves, and the pitch $P_2$ and the wave width $W_2$ of the waves in the large wave pattern fall within ranges of: $P_2$=2.0 mm to 10.0 mm, and $W_2$=0.1 mm to 1.2 mm.

5. The sheet die-cutting blade of claim 4, wherein the thickness of the blade plate is about 0.7 mm, the pitch $P_2$ and the wave width $W_2$ of the waves in the large wave pattern fall within ranges of: $P_2$=2.0 mm to 4.0 mm, and $W_2$=0.1 mm to 0.4 mm, and the pitch $P_1$ and the wave width $W_1$ of the waves in the small wave pattern fall within ranges of: $P_1$=0.4 mm to 0.8 mm, and $W_1$=0.04 mm to 0.1 mm.

6. The sheet die-cutting blade of claim 4, wherein the thickness of the blade plate is about 0.9 mm, the pitch $P_2$ and the wave width $W_2$ of the waves in the large wave pattern fall within ranges of: $P_2$=2.0 mm to 5.0 mm, and $W_2$=0.1 mm to 0.6 mm, and the pitch $P_1$ of the waves in the small wave pattern fall within a range of: $P_1$=0.6 mm to 1.2 mm and $W_1$=0.05 mm to 0.2 mm.

7. The sheet die-cutting blade of claim 4, wherein the thickness of the blade plate is about 1.07 mm, the pitch $P_2$ and the wave width $W_2$ of the waves in the large wave pattern fall within ranges of: $P_2$=3.0 mm to 6.0 mm, and $W_2$=0.2 mm to 0.8 mm, and the pitch $P_1$ and the wave width $W_1$ of the waves in the small wave pattern fall within ranges of: $P_1$=0.8 mm to 1.4 mm, and $W_1$=0.08 mm to 0.3 mm.

* * * * *